US006471316B1

(12) United States Patent
Seto

(10) Patent No.: US 6,471,316 B1
(45) Date of Patent: Oct. 29, 2002

(54) INK-JET PRINTER IN WHICH HIGH SPEED PRINTING IS POSSIBLE

(75) Inventor: Shinji Seto, Tokyo (JP)

(73) Assignee: NEC Corporation (JP)

( * ) Notice: Subject to any disclaimer, the term of this patent is extended or adjusted under 35 U.S.C. 154(b) by 0 days.

(21) Appl. No.: 09/454,356

(22) Filed: Dec. 3, 1999

(30) Foreign Application Priority Data

Dec. 9, 1998 (JP) ..... 10-349718

(51) Int. Cl.[7] ..... B41J 2/045
(52) U.S. Cl. ..... 347/9; 347/10
(58) Field of Search ..... 347/9, 10, 11, 347/56, 20, 54, 57, 68, 72

(56) References Cited

U.S. PATENT DOCUMENTS 5,381,171 A * 1/1995 Hosono et al. ..... 347/72
5,521,619 A * 5/1996 Suzuki et al. ..... 347/10

FOREIGN PATENT DOCUMENTS

| | | |
|---|---|---|
| JP | 56-7184 | 1/1981 |
| JP | 59-10495 | 1/1984 |
| JP | 2-195868 | 8/1990 |
| JP | 5-318766 | 12/1993 |
| JP | 5-338148 | 12/1993 |
| JP | 5-338150 | 12/1993 |
| JP | 6-218928 | 8/1994 |
| JP | 9-29959 | 2/1997 |
| JP | 9-226116 | 9/1997 |

OTHER PUBLICATIONS

Japanese Office Action issued Jan. 18, 2001 in a related application with English translation of relevant portions.

* cited by examiner

*Primary Examiner*—Anh T. N. Vo
(74) *Attorney, Agent, or Firm*—Dickstein, Shapiro, Morin & Oshinsky, LLP

(57) ABSTRACT

An ink-jet printer includes a nozzle, an ink storage room, an actuator and a drive section. Ink drops are discharged from the nozzle in a print operation. The ink storage room stores ink. The actuator applies pressure to the ink stored in the ink storage room for the ink drops to be discharged in response to each of a drive signal and a preliminary drive signal. The drive section selectively issues one of the drive signal and the preliminary drive signal to the actuator for each of unit time periods, based on whether or not the ink drops should be discharged. The unit time period is shorter than a time period needed until vibration of an ink meniscus in an end portion of the nozzle is attenuated.

16 Claims, 10 Drawing Sheets

INK-JET PRINTER IN WHICH HIGH SPEED PRINTING IS POSSIBLE

BACKGROUND OF THE INVENTION

1. Field of the Invention

The present invention relates to a technique for driving a print head of an ink-jet printer.

2. Description of the Related Art

In a print head driving method in a conventional drop on-demand type ink-jet printer, a drive voltage signal is applied to a print head every time a print instruction is issued, and ink drops are discharged from a nozzle to carry out a print operation.

FIG. 1 is a diagram showing an example of the structure of the print head of an ink-jet printer. As shown in FIG. 1, the print head 12 is composed of an ink discharging nozzle 14, an ink pressure increasing room 16, an actuator 18, and a drive signal generating circuit 19. The ink pressure increasing room 16 is connected to the nozzle 14. The actuator 18 receives a pulse drive voltage signal and applies a pressure to ink in the ink pressure increasing room 16 in accordance with the magnitude of a drive voltage signal. The drive signal generating circuit 19 generates the drive voltage signal which should be applied to the actuator 18.

The print head 12 is subjected to a repetitive reciprocating motion in a print region along a paper (not shown). In this state, the pulse drive voltage signal is generated by the drive signal generating circuit 19 and is repeatedly supplied to the actuator 18. As a result, the ink in the ink pressure increasing room 16 is pressurized so that ink drops are discharged from the nozzle 14 to the paper. The supply and non-supply of the pulse drive voltage signal generated by the drive signal generating circuit 19 to the actuator 18 are controlled so that a print operation to the paper is carried out.

FIGS. 2A to 2C are waveform diagrams showing the waveform of the drive voltage signal, the displacement of ink meniscus at the nozzle tip section and the velocity of an ink meniscus at the nozzle tip section, respectively. In FIGS. 2A to 2C, the horizontal axis indicates time and a vertical axis indicates voltage in FIG. 2A, the displacement of the meniscus in FIG. 2B, and the meniscus velocity in FIG. 2C, respectively.

When the drive voltage signal is supplied to the actuator 18 as shown in FIG. 2A, the drive voltage signal increased rapidly between a point A and a point B, and ink 20 in the ink pressure increasing room 16 is also pressurized rapidly by the actuator 18. At this time, the meniscus velocity in the nozzle tip section is rapidly increased between a point X and a point Y in FIG. 2C. The ink meniscus 22, 21 changes from the original state shown in FIG. 3A to the state shown in FIG. 3B, and the discharge of ink drop from the tip section of the nozzle 14 is started. Thus, an ink pillar 24 is first formed. At this time, the displacement quantity of the meniscus 22 becomes large rapidly as shown in FIG. 3B.

After that, the drive voltage signal is settled to a constant value between the point P and a point C in FIG. 2A. As a result, the pressure of the meniscus 22 decreases and the velocity of the ink meniscus in the nozzle tip section starts to decrease between a point Y and a point Z in FIG. 2C. Thus, the difference in meniscus velocity between the ink pillar 24 discharged from the nozzle 14 and the ink within the nozzle becomes large. For this reason, as shown in FIG. 3C, the ink pillar 24 is cut off from the ink within the nozzle 14 and an ink drop 26 is discharged from the nozzle 14.

It should be noted that the drive voltage signal is sometimes decreased depending on a printer, instead of keeping constant between the point B and the point C shown in FIG. 2A. In the case, the drive voltage signal is decreased at the timing earlier than the velocity of the ink meniscus. However, the basic operation is the same.

After the ink drop 26 is discharged, the position of the meniscus 22 in the tip section of nozzle 14 is recessed to the side of the nozzle proximate by a quantity equivalent to discharged ink drop, as shown in FIG. 3D.

After that, the recessed meniscus 22 tries to return to the original position by surface tension in the tip section of the nozzle 14 and vibrates (refill phenomenon). Also, the recessed meniscus 22 undergoes influence of the remaining vibration of the pressure wave by the actuator 18. Thus, the meniscus vibrates. The vibration attenuates gradually and the meniscus 22 returns to the original position as shown in FIG. 2B, and FIG. 3A. Also, the velocity of ink meniscus attenuates gradually and becomes a zero, as shown in FIG. 2C. Such an operation is repeated every time the drive voltage signal is supplied to the actuator 18 and the print operation is carried out.

By the way, the ink meniscus in the nozzle section vibrates for a time as mentioned above, when the drive voltage signal is once supplied and the ink drop is discharged. Therefore, the ink drop can be next discharged at the timing of Q in FIG. 2A or after that. That is, the next discharge of the ink drops is after the vibration of the ink meniscus 22 has been settled. However, it is impossible to print at high speed, because the supply period of the drive voltage signals becomes long in the above-mentioned condition. For this reason, it could be considered that the drive voltage signal is supplied to the actuator 18 before the timing of Q and ink drops are discharged.

For example, as shown in FIG. 2B, the position of the ink meniscus returns to the original position at the timing of A in FIG. 2A. Therefore, it is effective to supply the drive voltage signal at this timing. However, at the timing of O, the ink meniscus is moving with some velocity as shown in FIG. 2C. Therefore, when the drive voltage signal is supplied at this timing, the velocity of the ink meniscus is equal to an addition of the above remaining velocity and a velocity determined in response to the new drive voltage signal. This is different from the desired velocity and causes the degradation of the print quality.

On the other hand, as shown in FIG. 2C, the ink meniscus stops at the timing of P. In this case, if the following drive voltage signal is supplied, there is no problem with respect to the meniscus velocity of the ink. However, as shown in FIG. 2B, because the ink meniscus is displaced largely, the quantity of discharged ink drop is different from the desired quantity and still causes the degradation of the print quality.

To solve these problems, various methods are conventionally proposed, in which after the drive voltage signal is once supplied, a preliminary drive voltage signal is supplied to control the ink meniscus and makes high-velocity print possible.

Also, various methods are proposed in which a quantity of ink discharged from the nozzle 14 is increased through the once drive of the actuator 18 so that the discharge efficiency of ink is improved.

Hereinafter, three representative methods will be described.

In the first conventional method, the ink meniscus 22 at the tip section of the nozzle 14 is returned to an initial state, i.e., the state before the ink drops are discharged, as soon as possible. The repetition period of the supply of the drive voltage signal is made small. For this purpose, the drive voltage signal is supplied to restrain the remaining vibration of the meniscus 22 after supply of the drive voltage signal. For example, the first conventional method is disclosed in Japanese Laid Open Patent Application (JP-A-Heisei 5-338150) and Japanese Laid Open Patent Application (JP-A-Showa 59-10495).

FIG. 4A is a waveform diagram showing the waveform of the drive voltage signal and the preliminary drive voltage signal in the first conventional driving method. FIG. 4B is a waveform diagram showing the drive voltage signal and the preliminary drive voltage signal which are repeatedly supplied to the actuator 18 in the first conventional driving method.

As shown in FIG. 4A and 4B, in the first conventional driving method, every time the drive voltage signal 28 is supplied to the actuator 18 to discharge the ink drops, the preliminary drive voltage signal 30 is supplied to restrain the remaining vibration of the ink meniscus immediately after. Therefore, the drive voltage signal 28 is once supplied and then the ink meniscus 22 is always reset to the initial state at the timing when the next drive voltage signal is supplied, i.e., at the timing shown by a dotted line in FIG. 4B.

It should be noted that when the preliminary drive voltage signal is supplied to the actuator 18, the velocity of ink meniscus in the nozzle 14 changes as shown in FIG. 2C, like the case where the drive voltage signal is supplied. However, in case of the supply of the preliminary drive voltage signal, the change of the meniscus velocity between the points P and Q in FIG. 2C is small, even if the ink pillar 24 protrudes from the nozzle 14. Therefore, the ink pillar 24 is not cut off and the ink drop is not discharged, as shown in FIG. 3C.

In the second conventional driving method, the ink drops are discharged using the vibration of the ink meniscus so that the discharge efficiency of ink is improved. For this purpose, the preliminary drive voltage signal is supplied before the drive voltage signal is supplied (Japanese Laid Open Patent Applications (JP-A-Heisei 5-338148, JP-A-Heisei 5-318766, and JP-A-Heisei 9-29959).

FIG. 5A is a waveform diagram showing waveforms of the preliminary drive voltage signal and drive voltage signal in the second conventional driving method. FIG. 5B is a waveform diagram showing the preliminary drive voltage signal and the drive voltage signal which are repeatedly supplied to the actuator 18 in the second conventional driving method.

As shown in FIGS. 5A and 5B, in the second conventional driving method, the preliminary drive voltage signal 29 is always supplied before the drive voltage signal 31 is supplied to the actuator 18. Therefore, the supply of preliminary drive voltage signal 29 vibrates the ink meniscus 22, and the drive voltage signal 31 is supplied at the timing of substantially the same vibration state and the ink drops are discharged from the nozzle 14.

In a third conventional driving method, the solvent of ink volatilizes in the tip section of the nozzle 14, so that it is easy to increase the viscosity coefficient of ink. When the viscosity coefficient of ink is increased, the characteristic of the discharge of ink drops changes largely and causes the degradation of the print quality. In the third conventional driving method, increase in viscosity coefficient of ink is prevented. For this purpose, the print head 12 is regularly moved to the nozzle cleaning mechanism section and the ink drops are discharged, (Hereinafter, this operation will be referred to as a purge). Also, the drive voltage signal is supplied to the extent to which the ink discharge is not carried out, when the print head 12 is in the non-print region (Japanese Patent Application No. Heisei 2-195868).

Moreover, a method is proposed in Japanese Laid Open Patent Application (JP-A-Heisei 9-226116). In this reference, the preliminary drive voltage signal is supplied before the drive voltage signal is supplied to the actuator 18, when the ink drops are discharged during the period next to the period during which any ink drops are not discharged.

As described above, the first conventional driving method is the method of reducing the drive period for the actuator 18 or increasing an drive frequency. Also, the second conventional driving method is the method of increasing the discharge efficiency of ink. By these methods, there is a case where both of the increase of the drive frequency for the actuator 18 and the increase of the discharge efficiency of ink should be attained at the same time. In such a case, the preliminary drive voltage signal. is first supplied to preliminarily vibrates the ink meniscus, and then the drive voltage signal is supplied to discharge the ink drops. Next, the preliminary drive voltage signal is supplied to restrain the remaining vibration of the ink meniscus 22.

It is supposed that the first and second drive voltage signals are supplied to the actuator 18 during the current period and the next period. In this case, the preliminary drive voltage signal is supplied to the actuator 18 between the first drive voltage signal and the second drive voltage signal to restrain the vibration of the ink meniscus 22. Then, the preliminary drive voltage signal is supplied to the actuator 18 between the first drive voltage signal and the second drive voltage signal to vibrate the ink meniscus 22 preliminarily. That is, it is necessary to carry out a wasteful operation in which the vibration of the ink meniscus 22 is again started after the remaining vibration of the ink meniscus is once restrained. Thus, the drive frequency of the actuator 18 is rather decreased.

Also, it could be considered that the preliminary drive voltage signal is only once supplied in case of the continuation drive. In this case, however, it is necessary to manage whether or not the ink drops have been discharged during the previous period, i.e., to manage whether or not the continuation drive is carried out. Thus, a new problem is caused that the supply control of the drive voltage signal becomes complicated.

In the third conventional driving method, the preliminary drive voltage signal is supplied to the actuator 18 under the condition that the print head 12 is moved to the non-print region to make it possible to prevent the increase of the viscosity coefficient of ink in the tip section of the nozzle 14 as mentioned above. However, a case where the printing operation is carried out only in a top or bottom section in the print region could be considered as an example. In this case, the ink drops are not discharged while the print head 12 is moved to the bottom section of the print region, after the ink drops are discharged at the head section of the print region. Therefore, the evaporation of ink solvent increases the viscosity coefficient of ink until the print head reaches the bottom section of the print region, so that it is easy for the print quality to be degraded.

Also, when the ink drops are discharged at the next period to the current period during which any ink drops are not discharged, it is necessary to manage whether or not the ink drops are discharged at the previous period, in the method of supplying the preliminary drive voltage signal to the actuator 18. In this case, a new problem is caused that the supply control of the drive voltage signal becomes complicated, like the above-mentioned case.

In conjunction with the above description, an ink-jet type printer is disclosed in Japanese Laid Open Patent Application (JP-A-Heisei 6-218928). In this reference, a drive signal circuit (49) generates a first voltage to make a piezo-electric vibrator extend at a velocity suitable for formation of ink drops, a second voltage to hold an expanded state or a shrunk state of the piezo-electric vibrator, and a third voltage to make the piezo-electric vibrator shrink at a velocity suitable for attraction of ink into a pressure generating room. A discharge end detecting circuit (52) detects a timing when an ink drop generating process is ended in response to the first voltage. A delay circuit (53) delays a signal outputted from the circuit (52) by a time ΔT until the vibration of meniscus produced in the ink drop generating process is switched into a motion to a nozzle opening. A charge signal generating circuit (48) drives the circuit (49) to generate the third voltage in response to the delayed signal from the delay circuit (53). A discharge signal generating circuit (51) drives the circuit (49) to generate the first voltage in response to a print timing signal.

SUMMARY OF THE INVENTION

Therefore, an object of the present invention is to provide an apparatus of driving a print head in an ink-jet printer, in which a drive period of an actuator can be made short with a simple control, resulting in improvement of a print speed.

Another object of the present invention is to provide an apparatus of driving a print head in an ink-jet printer, in which a condition of the discharge of ink can be held constant, resulting in improvement of print quality.

Still another object of the present invention is to provide an apparatus of driving a print head in an ink-jet printer, in which the discharge efficiency of ink is improved so that print quality can be improved.

Yet still another object of the present invention is to provide an apparatus of driving a print head in an ink-jet printer, in which it is possible to prevent increase in viscosity coefficient of ink so that print quality can be improved.

In order to achieve an aspect of the present invention, an ink-jet printer includes a nozzle, an ink storage room, an actuator and a drive section. Ink drops are discharged from the nozzle in a print operation. The ink storage room stores ink. The actuator applies pressure to the ink stored in the ink storage room for the ink drops to be discharged in response to each of a drive signal and a preliminary drive signal. The drive section selectively issues one of the drive signal and the preliminary drive signal to the actuator for each of unit time periods, based on whether or not the ink drops should be discharged. The unit time period is shorter than a time period needed until vibration of an ink meniscus in an end portion of the nozzle is attenuated.

Here, the drive section issues the drive signal to the actuator at a start timing of a print unit time period of the unit time periods when the ink drops should be discharged in the print unit time period.

Also, the drive section issues the preliminary drive signal to the actuator at a predetermined timing of a non-print unit time period of the unit time periods when the ink drops should not be discharged in the non-print unit time period. In this case, it is preferable that a time from a start timing to the predetermining timing in one of the unit time periods is longer than a time from a start timing to a timing when the drive signal is issued, in another of the unit time periods. Also, the predetermining timing in a current one of the unit time periods may be determined based on a vibration waveform of the ink meniscus when the drive signal is issued in one of the unit time periods immediately previous the current unit time period.

Also, the drive section determines a waveform of the preliminary drive signal and a timing of issuance of the preliminary drive signal such that vibration of the ink meniscus at a start timing of a next unit time period to a current unit time period when the drive signal is issued in the current unit time period is substantially the same as that of the ink meniscus at the start timing of the next unit time period when the preliminary drive signal is issued in the current unit time period in place of the drive signal. In this case, the drive section includes a drive circuit determining the waveform of the preliminary drive signal, and a timing setting circuit setting a timing at which the preliminary drive signal should be issued.

Also, a print head includes the nozzle, the ink storage room and the actuator, and the drive section issues the preliminary drive signal in one of the unit time periods immediately before the print head is moved from an outside of a print region into an inside of the print region.

In order to achieve another aspect of the present invention, a method of driving a print head of an ink-jet printer, includes:

issuing a drive signal in a current time period such that ink drops are discharged for a print operation, an ink meniscus having remaining vibration after the discharging of the ink drops; and issuing the drive signal in a next time period to the current time period, wherein the remaining vibration of the ink meniscus is not fully attenuated.

Here, the drive signal is issued at a start timing of the current unit time period.

Also, the method may further include issuing a preliminary drive signal at a predetermined timing of the next time period when the ink drops are not discharged. In this case, it is preferable that a time from a start timing to the predetermining timing in the next time period is longer than a time from a start timing to a timing when the drive signal is issued, in the next time period. Also, the predetermining timing is determined based on the remaining vibration of the ink meniscus when the drive signal is issued in the current time period.

Also, a waveform of the preliminary drive signal and a timing of the issuance of the preliminary drive signal are determined such that the remaining vibration of the ink meniscus in a tip section of a nozzle at a start timing of the next unit time period is substantially the same as that of the ink meniscus at the start timing of the next time period when the preliminary drive signal is issued in the current time period in place of the drive signal.

Also, the method may further include issuing the preliminary drive signal in a time period immediately before a print head is moved from an outside of a print region into an inside of the print region.

DESCRIPTION OF THE PREFERRED EMBODIMENTS

Next, an ink-jet printer with a print head driving apparatus of the present invention will be described with reference to the attached drawings.

Figure 1:
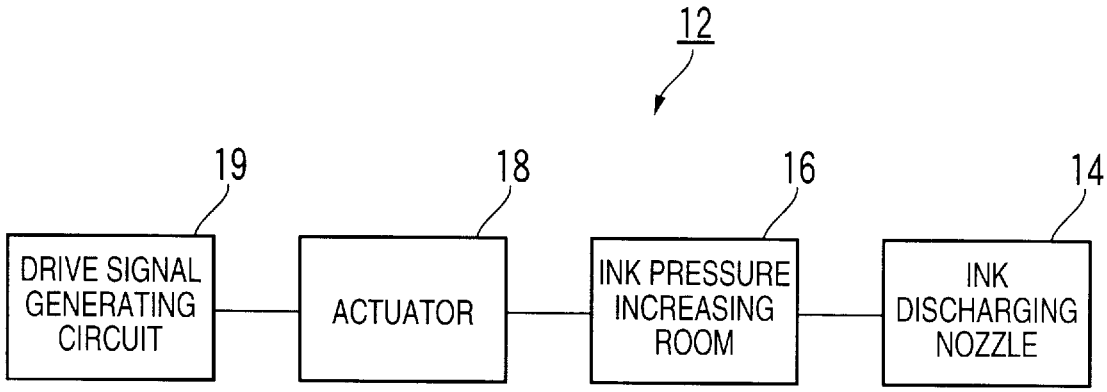
Fig. 1 PRIOR ART
FIG. 1 is a block diagram showing the structure of a first conventional example of a print head of an ink-jet printer.
Figure 2A:
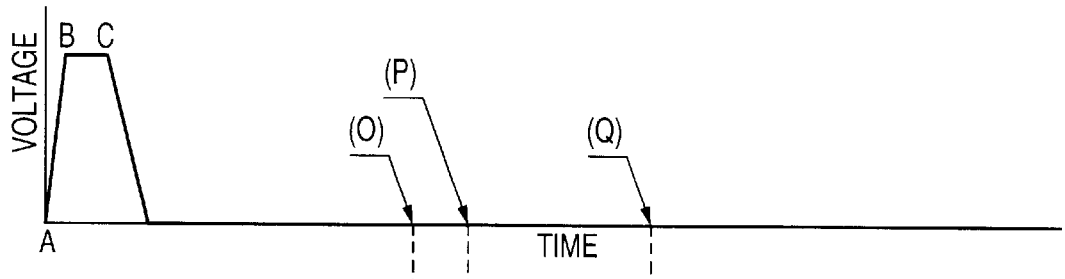
Fig. 2A PRIOR ART
FIGS. 2A to 2C are waveform diagrams showing the waveform of a drive voltage signal, the displacement of ink meniscus at a nozzle section and the velocity of ink meniscus in the first conventional example of the print head of the ink-jet printer, respectively.
Figure 2B:
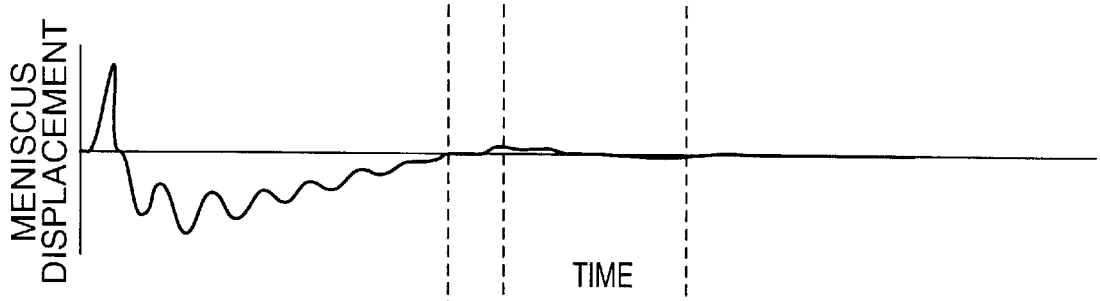
Fig. 2B PRIOR ART
Figure 2C:
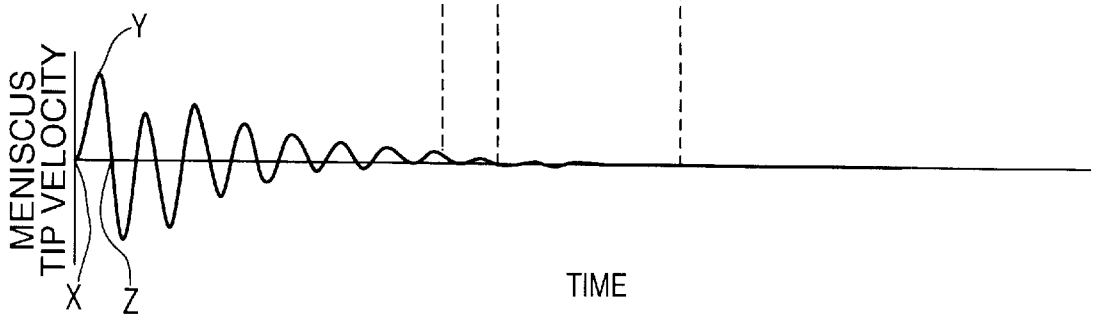
Fig. 2C PRIOR ART
Figure 3A:
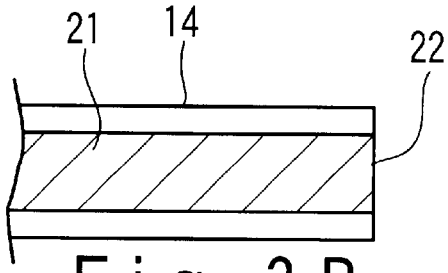
Fig. 3A PRIOR ART
FIGS. 3A to 3D are diagrams showing the states of ink meniscus at the tip section of the nozzle in the conventional example of the print head of the ink-jet printer.
Figure 3B:
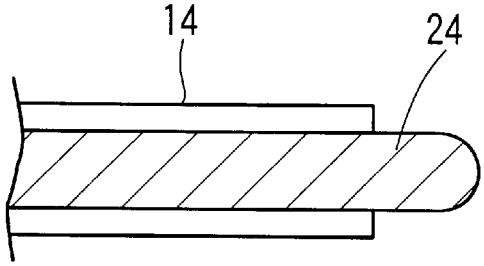
Fig. 3B PRIOR ART
Figure 3C:
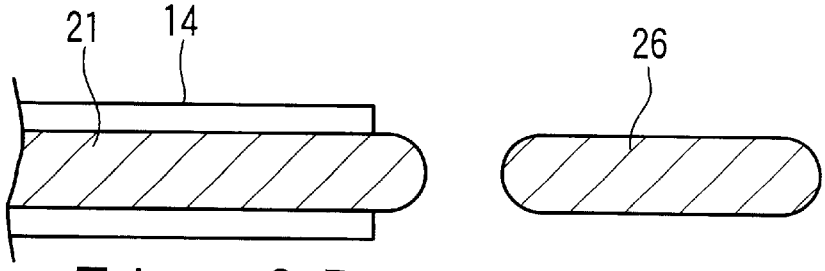
Fig. 3C PRIOR ART
Figure 3D:
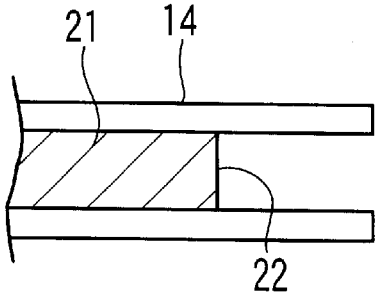
Fig. 3D PRIOR ART
Figure 4A:
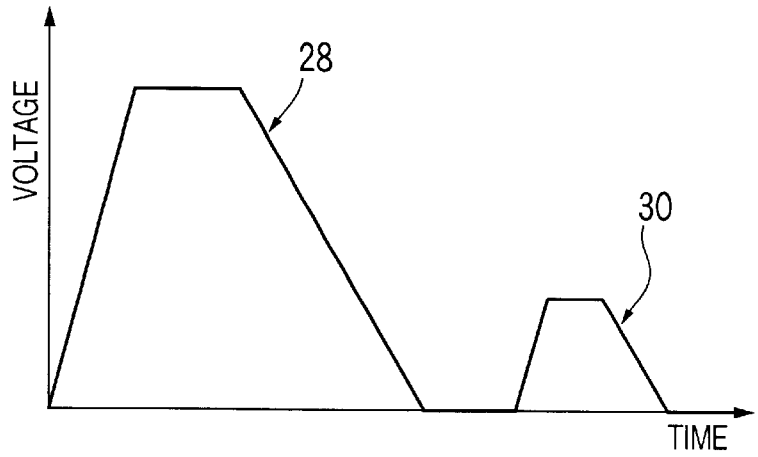
Fig.4A PRIOR ART
FIG. 4A is a waveform diagram showing the waveform of a drive voltage signal and the waveform of a preliminary drive voltage signal in a second conventional example of the print head of the ink-jet printer.
Figure 4B:
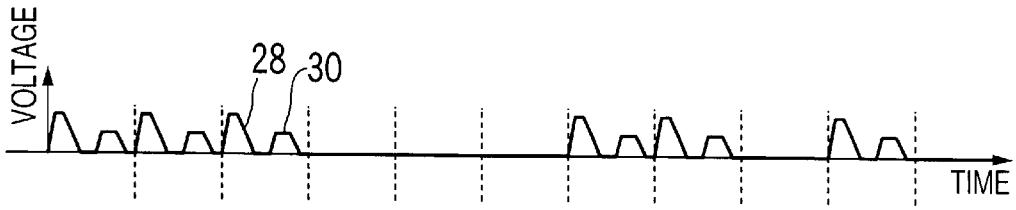
Fig.4B PRIOR ART
FIG. 4B is a waveform diagram showing the drive voltage signal and the preliminary drive voltage signal which are repeatedly supplied to an actuator in the second conventional example of the print head of the ink-jet printer.
Figure 5A:
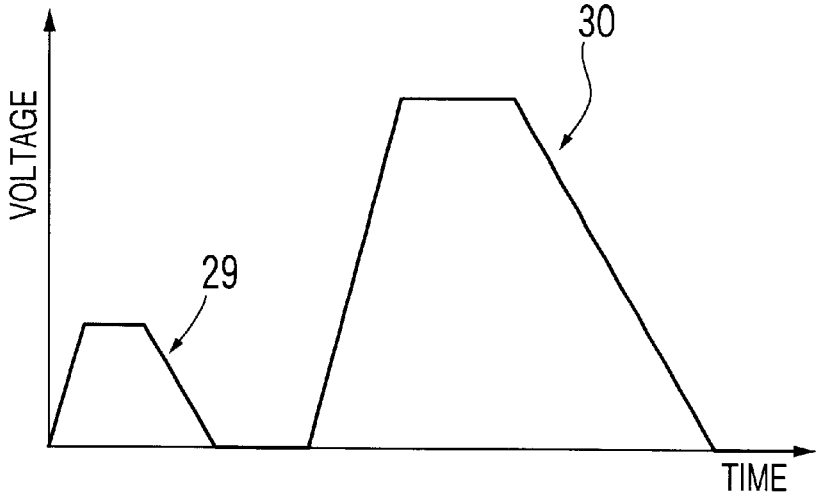
Fig.5A PRIOR ART
FIG. 5A is a waveform diagram showing the waveform of the drive voltage signal and the waveform of the preliminary drive voltage signal in a third conventional example of the print head of the ink-jet printer.
Figure 5B:
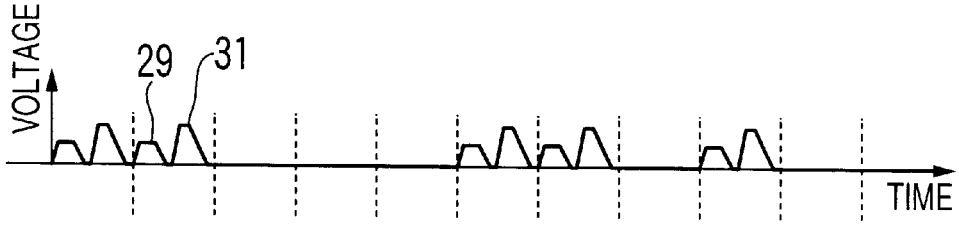
Fig.5B PRIOR ART
FIG. 5B is a waveform diagram showing the drive voltage signal and the preliminary drive voltage signal which are repeatedly supplied to an actuator in the third conventional example of the print head of the ink-jet printer.
Figure 6:
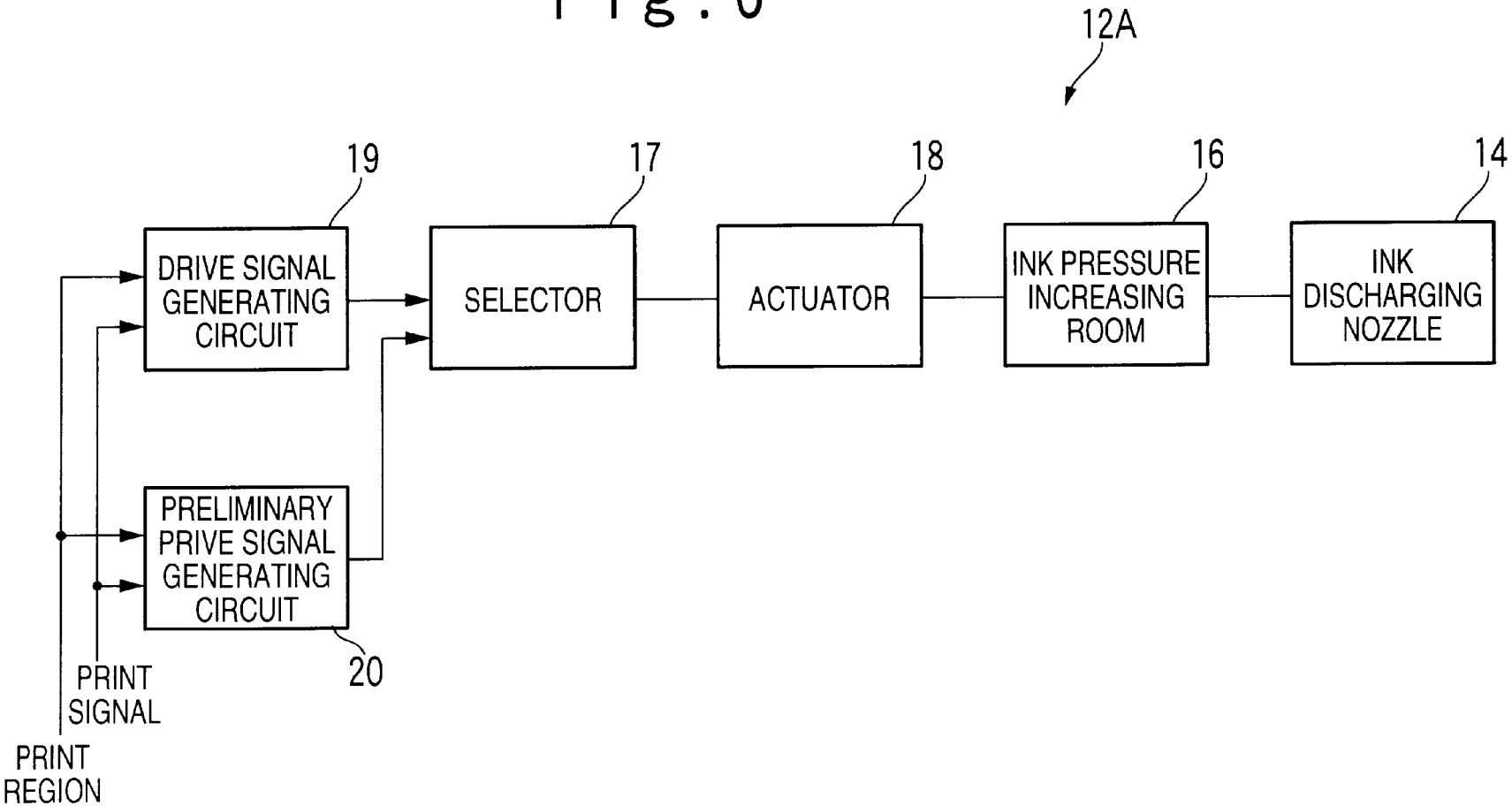
FIG. 6 is a block diagram showing the structure of a print head of an ink-jet printer according to a first embodiment of the present invention.

First, the structure of the print head driving apparatus 12A of the ink-jet printer according to the first embodiment of the present invention will be described with reference to FIG. 6. Referring to FIG. 6, the print head driving apparatus 12A is composed of an ink discharging nozzle 14, an ink pressure increasing room 16, an actuator 18, a selector 17, and a driving section. The driving section is composed of a drive signal generating circuit 19 and a preliminary drive signal generating circuit 20.

In this embodiment, a print time period is divided into a plurality of unit time periods. The driving section receives a print signal and a print region signal. The print signal indicates whether or not a print operation should be carried out in the next unit time period. Also, the print region signal indicates whether the print head enters a print region in the next unit time period. The drive signal generating circuit 19 generates a drive voltage signal at the start timing of each unit time period in response to the print signal when the print operation is carried out in the next unit time period. The preliminary drive voltage signal generating circuit 20 generates a preliminary drive voltage signal at a predetermining timing in each unit time period in response to the print signal when the print operation is not carried out in the next unit time period.

The selector 17 selects one of the preliminary drive voltage signal and the drive voltage signal to supply to the actuator 18. The preliminary voltage signal and the drive voltage signal are supplied to the actuator 18 at the timings to be mentioned later.

In the print head driving apparatus of the ink-jet printer in the first embodiment, a printer head 12 having the structure mentioned above is reciprocally and repetitively moved in a print region along a print paper or a print media by a print head drive mechanism (not shown). Also, the pulse drive voltage signal or the preliminary drive voltage signal is applied to the actuator 18 repeatedly by the driving section through the selector 17 while the print head 12 is reciprocally moved. The repetitive supply of the drive voltage signal to the actuator 18 pressurizes ink in the ink pressure increasing room 16 to allow ink drops to be discharged from the nozzle 14 to the print paper.

Figure 7:
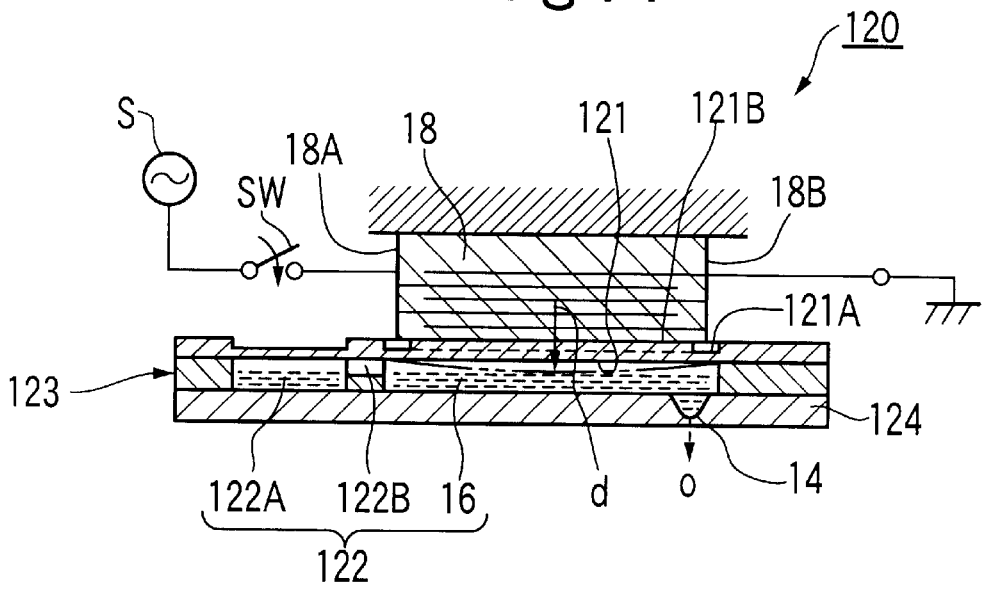
FIG. 7 is a cross sectional view showing the structure of a mechanical section of the print head of the ink-jet printer according to the first embodiment of the present invention.

Next, the ink-jet printer with the print head according to the first embodiment will be described with reference to FIG. 7. A print head mechanical section 120 is composed of the actuator 18, a diaphragm 121, an ink flow path 122, an ink flow path plate 123 and a nozzle plate 124. The actuator 18 is composed of a piezoelectric element and the diaphragm 121 transfers the mechanical energy of the actuator 18 to the ink. The ink flow path 122 is provided in the ink flow path plate 123 formed of a thick plate. The ink flow path 122 is composed of an ink accommodating rooms 122A to accommodate supplied ink and the ink supply path 122B to direct the ink accommodated in the ink accommodating room 122 to the ink pressure increasing room 16, and the ink pressure increasing room 16. The nozzle 14 is formed to pass through a nozzle plate 124 to the ink pressure increasing room 16.

The actuator 18 has one 18A of the electrodes which are formed over a plurality of layers and the other electrode 18B. Two concave grooves 121A are formed above the diaphragm 121 to sandwich a region to be pushed by the diaphragm 121 which is pushed by the actuator 18. A projection section 121B is formed by the actuator 18. By pushing the projection section 121B by the actuator 18, the ink in the ink pressure increasing room 16 which is located under the diaphragm 21 is pressurized.

Also, the ink is filled from the ink accommodating room 122A to the nozzle 14 via the ink pressure increasing room 16 and the ink supply path 122B.

After a switch SW is turned on, the drive voltage signal S which is equivalent to the drive voltage signal or a preliminary drive voltage signal as mentioned above, is applied to the 14. actuator 18. At this time, the actuator 18 operates in the direction of arrow d, i.e., in the direction in which the ink pressure increasing room 16 is pressurized through the projection section 121B of the diaphragm 121, as shown in FIG. 7. Through the operation of the actuator 18, the ink in the ink pressure increasing room 16 is pressurized so that a part of the ink is discharged from the nozzle 14. When the switch SW is turned off so that application of the drive voltage signal S is canceled, the actuator 18 returns to the initial state so that the discharge of the ink is stopped.

Figure 8A:
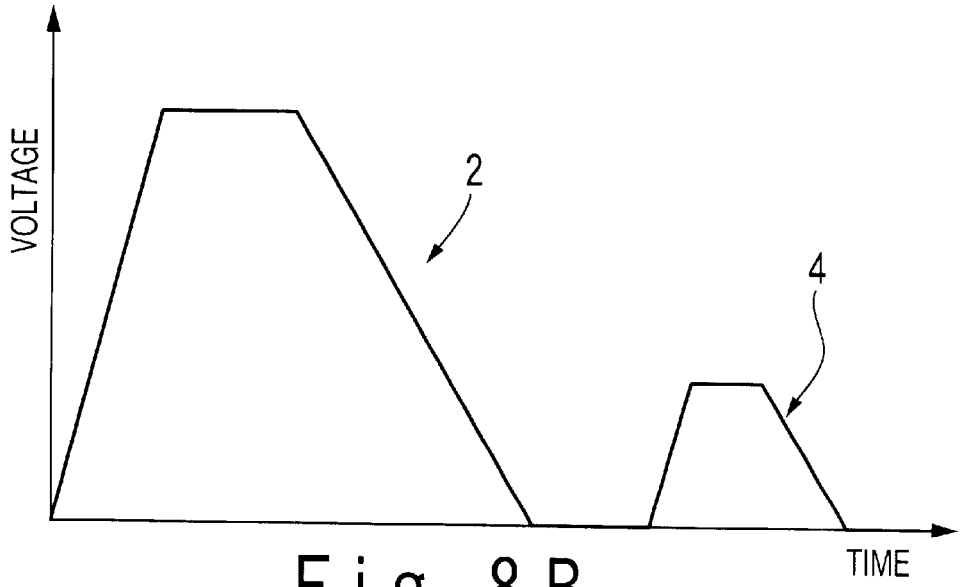
FIG. 8A is a waveform diagram showing the waveform with a drive voltage signal and the waveform of a preliminary drive voltage signal in the print head of the ink-jet printer according to the first embodiment of the present invention.
Figure 8B:
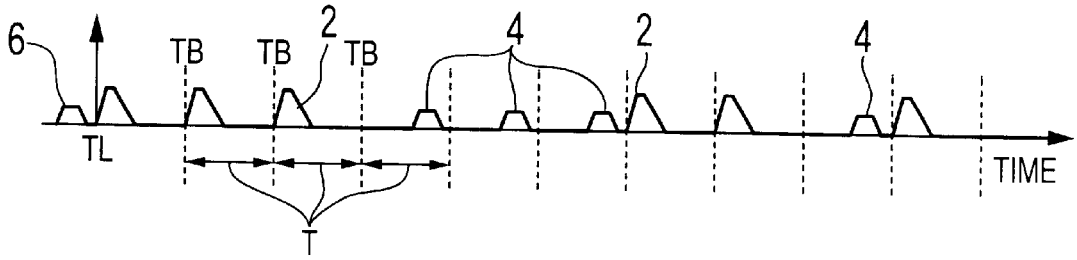
FIG. 8B is a waveform diagram showing the drive voltage signal and the preliminary drive voltage signal which are repeatedly supplied to an actuator in the print head of the ink-jet printer according to the first embodiment of the present invention.

By the way, as shown in FIG. 8B, the period when the print head 12 is moving in the print region is divided into a plurality of unit drive periods T having an approximately constant period. The drive voltage signal is supplied to the actuator 18 once per the unit drive period T at most.

The preliminary drive voltage signal 4 is supplied to the actuator 18 during the unit drive period T during which the drive voltage signal 2 is not supplied to the actuator 18, in the print head driving apparatus of the ink-jet printer in this embodiment. The preliminary drive voltage signal 4 is a pulse voltage signal similar to the drive voltage signal 2 and has a voltage lower than the drive voltage signal 2. As a result, the ink in the ink pressure increasing room 16 is pressurized to the extent that any ink drop is not discharged from the nozzle 14.

Figure 9A:
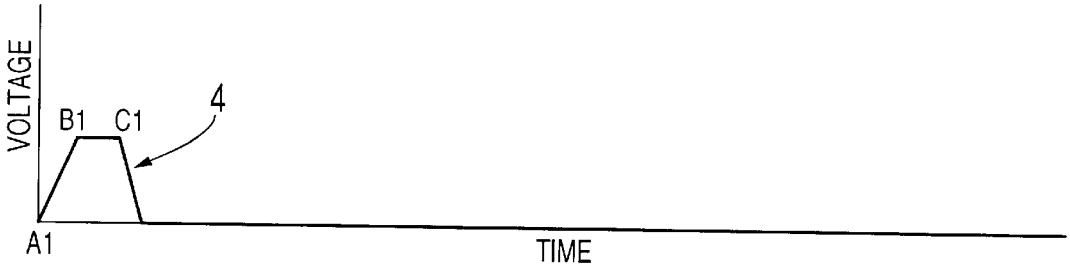
FIGS. 9A to 9C are waveform diagrams showing the waveform when only the preliminary drive voltage signal is supplied, the displacement of ink meniscus at a nozzle section and the velocity of the ink meniscus in the print head of the ink-jet printer according to the first embodiment of the present invention, respectively.
Figure 9B:
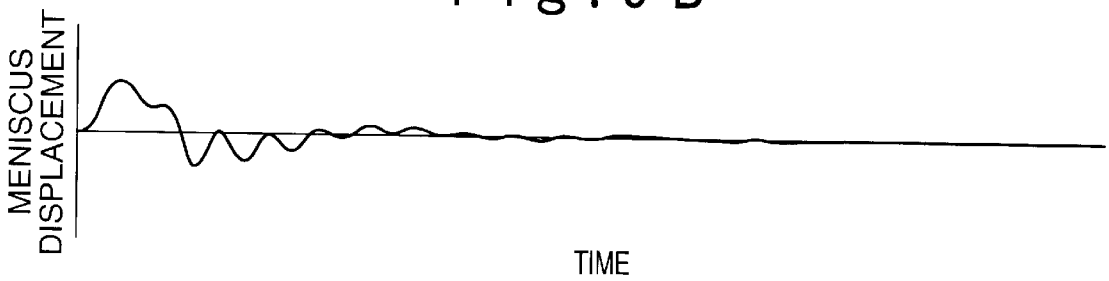
Figure 9C:
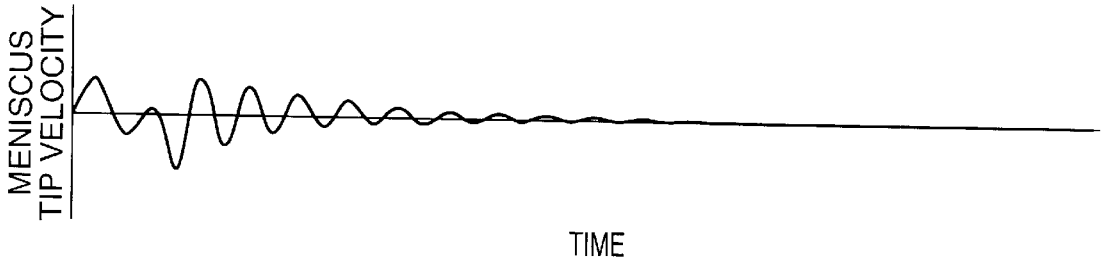

This preliminary voltage 4 will be described in detail. FIGS. 9A to 9C are a waveform diagram showing a waveform of the preliminary drive voltage signal 4, the displacement of the ink meniscus at the tip section of the nozzle 14 and the velocity of an ink meniscus in the nozzle tip section, respectively. In the figure, the horizontal axis shows time and the vertical axis expresses voltage in FIG. 9A, the displacement of the meniscus in FIG. 9B, and the velocity of the ink meniscus in FIG. 9C, respectively.

When the preliminary drive voltage signal 4 is supplied to the actuator 18 as shown in FIG. 9A, the drive voltage signal is rapidly increased between time A1 to time B1 and also the ink 20 in the ink pressure increasing room 16 is rapidly pressurized by the actuator 18. At this time, the ink drop velocity in the tip section of the nozzle 14 increases rapidly. However, a displacement quantity of the meniscus is suppressed to the extent that the ink does not protrude from the tip section of the nozzle 14.

After that, the drive voltage signal becomes constant between time B1 to time C1 in FIG. 9A. As a result, the pressure of the meniscus 22 decreases, and the displacement quantity of the meniscus and the ink meniscus velocity in the nozzle 14 tip section attenuates while vibrating and then converges to zero.

Referring to FIG. 8B again, the drive voltage signal 2 is supplied to the actuator 18 at the start timing TB of the unit drive period T. The preliminary drive voltage signal 4 is supplied to the actuator 18 at the timing which is later than the drive voltage signal 2 in the unit drive period T.

When the drive voltage signal 2 is supplied to the actuator 18 in the unit drive period T, the vibration has remaining in the ink meniscus 22 in the tip section of the nozzle 14 at the start timing of the of the following unit drive period T. This is because the drive voltage signal 2 is supplied to the actuator 18 before one unit drive period. That is, the length of the unit drive period T is set to be shorter than a period from when the actuator 18 is driven to when the vibration of the ink meniscus is completely converged.

Under this condition, the waveform and amplitude of the preliminary drive voltage signal 4, and the timing in the unit drive period are set as follows. That is, the vibration state of the ink meniscus 22 at the tip section of the nozzle 14 at the start timing of the next unit drive period when the drive voltage signal 2 is supplied to the actuator 18 during the unit drive period is approximately equal to the vibration state of the ink meniscus 22 at the tip section of the nozzle 14 at the start timing of the next unit drive period when the preliminary drive voltage signal 4 is supplied to the actuator 18 during the unit drive period. It should be noted that the vibration state of the meniscus 22 is determined based on the position of the meniscus 22 and the movement velocity thereof.

A method of making the above mentioned vibration states of the meniscus equal at the start timing of each unit drive period will be described with reference to FIGS. 10A to 10C and FIGS. 11A to 11C.

Figure 10A:
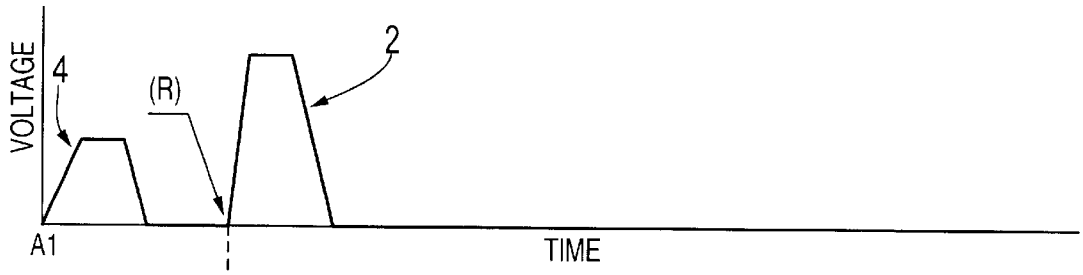
FIGS. 10A to 10C are waveform diagrams showing the waveform when the drive voltage signal is supplied following the preliminary drive voltage signal, the displacement of the ink meniscus at the nozzle section and the velocity of the ink meniscus in the print head of the inkjet printer according to the first embodiment of the present invention, respectively.
Figure 10B:
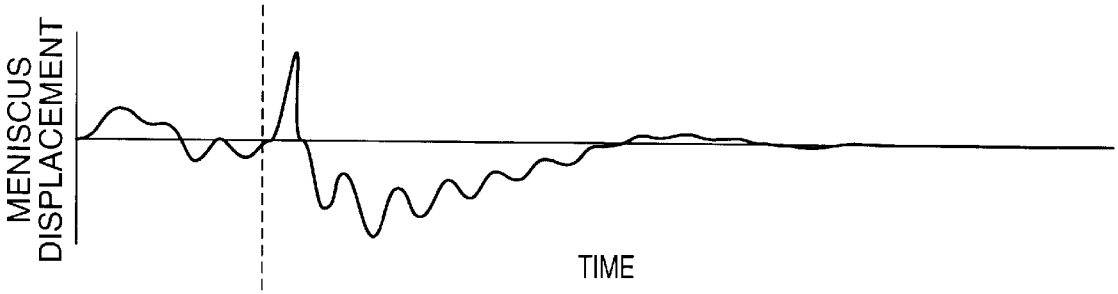
Figure 10C:
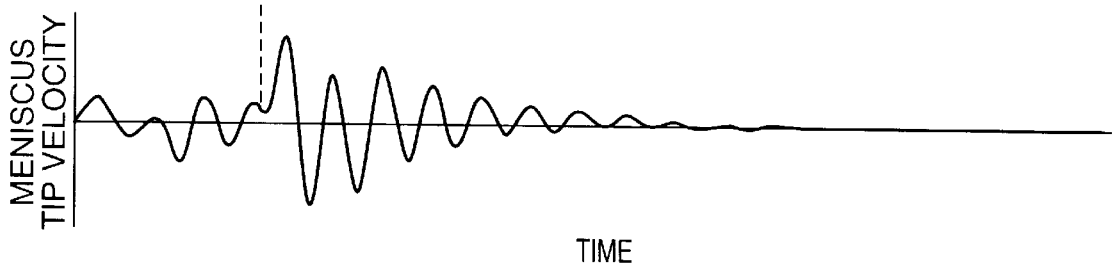

FIGS. 10A to 10C are a waveform diagram showing a waveform of a voltage, the displacement of the ink meniscus at the tip section of the nozzle 14 and the velocity of an ink meniscus at the tip section of the nozzle 14, respectively, when the preliminary drive voltage signal 4 is supplied to the actuator 18 during the unit drive period and then the drive voltage signal 2 is supplied to the actuator 18 at the start timing of the next unit drive period. In the figures, the horizontal axis shows time and the vertical axis expresses voltage in FIG. 10A, the displacement of the meniscus in FIG. 10B, and ink meniscus velocity in FIG. 10C, respectively.

The timing (R) shown in FIG. 10A indicates at the start timing of the unit drive period. As shown in FIG. 10B, at this timing (R), the meniscus displacement becomes zero. Also, as shown in FIG. 10C, the velocity of ink meniscus at the nozzle 14 tip section has a predetermined value in the direction in which the ink is discharged.

Figure 11A:
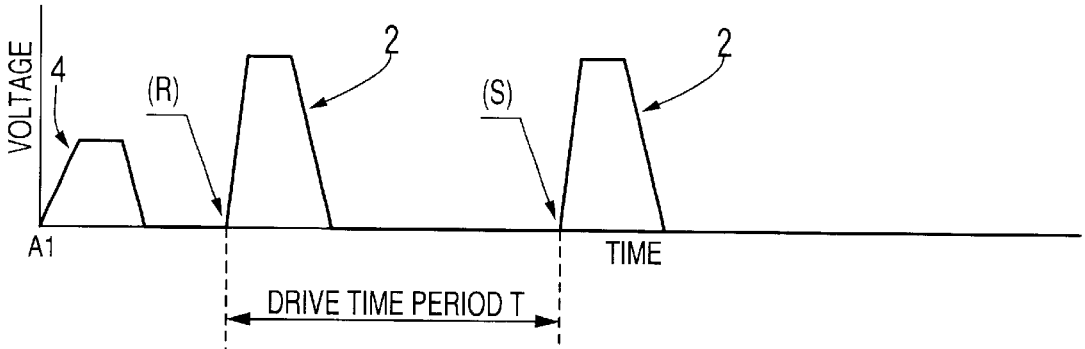
FIGS. 11A to 11C are waveform diagrams showing the waveform when the drive voltage signal are twice supplied following the preliminary drive voltage signal, the displacement of the ink meniscus at the nozzle section and the velocity of the ink meniscus in the print head of the ink-jet printer according to the first embodiment of the present invention, respectively.
Figure 11B:
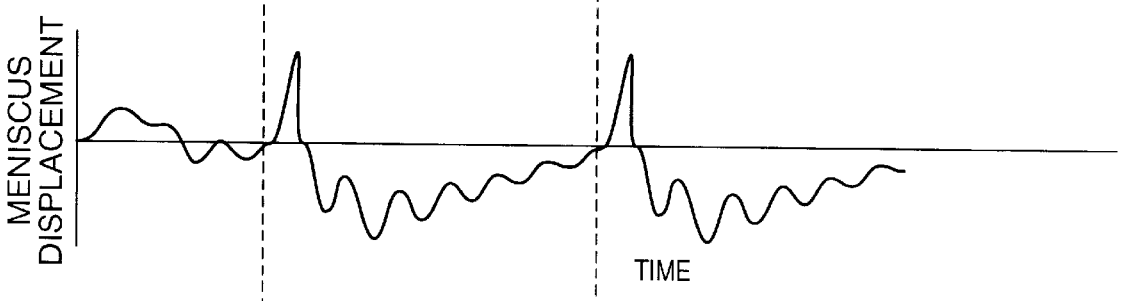
Figure 11C:
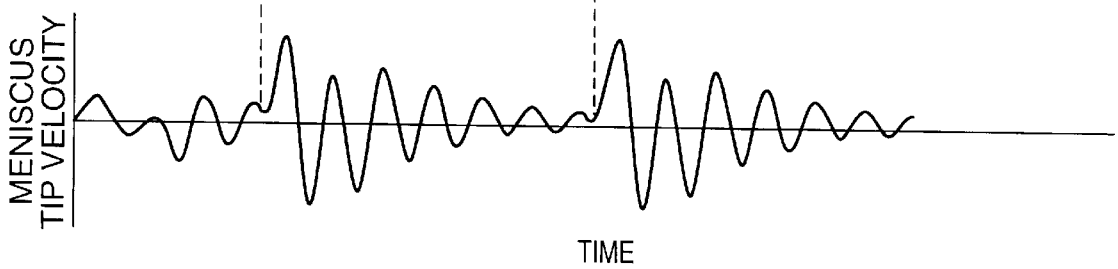

FIGS. 11A to 11C are a waveform diagram showing a waveform of a voltage, the displacement of the ink meniscus at the tip section of the nozzle 14 and the velocity of an ink meniscus at the tip section of the nozzle 14, respectively, when the preliminary drive voltage signal 4 and the drive voltage signal 2 are supplied to the actuator 18 during the unit drive period, and then the drive voltage signal 2 is supplied to the actuator 18 at the start timing of the next unit drive period. In the figures, the horizontal axis shows time and the vertical axis expresses voltage in FIG. 11A, the displacement of the meniscus in FIG. 11B, and ink meniscus velocity in FIG. 11C, respectively.

The timing (R) shown in FIG. 11A indicates the start timing of the unit drive period, the timing (S) indicates the start timing of the next unit drive period. The meniscus displacements are equal to zero at the timings (R) and (S), as shown in FIG. 11B. The velocity and direction of the ink drop shown in FIG. 11C are coincident with those of FIG. 10C. That is, the vibration state of the ink meniscus 22 at the tip section of the nozzle 14 at the timing (R), i.e., at the start timing of the next unit drive period when the preliminary drive voltage signal 4 is supplied to the actuator 18 during the unit drive period is approximately coincident with the vibration state of the ink meniscus 22 at the tip section of the nozzle 14 at the timing (S), i.e., at the start timing of the next unit drive period when the drive voltage signal 2 is supplied to the actuator 18 during the unit drive period.

As described above, the waveform and amplitude of the preliminary drive voltage signal 4, and the timing of the unit drive period for the preliminary drive voltage signal to be generated are set in such a manner that the vibration states of the meniscus are approximately coincident with each other between the respective start timings of the unit drive periods. In this case, the setting of the waveform and amplitude of the drive voltage signal 2 and preliminary drive voltage signal 4 are set by the preliminary drive signal generating circuit 20. The supply timings of the drive signal 2 and the preliminary drive signal 4 to the actuator 18 are set by the circuits 19 and 20, respectively.

It should be noted that the drive voltage signal 2 and the preliminary drive voltage signal 4 are increased in straight, held at constant levels and then are decreased in straight in this embodiment as shown in thin FIG. 8A. Also, there is described in this embodiment, the case that the single preliminary drive voltage signal 4 is supplied to the actuator 18 during the unit drive period. However, the number of preliminary drive voltage signals 4 to be supplied to the actuator 18 during the unit drive period may be more than one.

As above mentioned, in this embodiment, the length of the unit drive period is set shorter than a period necessary for the remaining vibration of the ink meniscus to fully converge. Therefore, the drive period of the actuator 18 can be shortened so that the print speed can be increased.

Also, even when the discharge of the ink drops are not carried out during the previous unit drive period, the vibration state of the ink meniscus at the start timing of the current unit drive period is approximately coincident with the vibration state in which the preliminary drive voltage signal 4 is supplied. This is because the preliminary drive voltage signal 4 is supplied in the previous unit drive period when the drive voltage signal 2 is not supplied in the previous unit drive period. Therefore, the ink drops are discharged in the same condition regardless of the discharge of the ink drops during the previous unit drive period, so that a good print quality can be attained.

Also, because the actuator 18 is driven in the state in which the ink meniscus vibrates, the ink discharge efficiency can be increased by use of the vibration of the ink meniscus. Also, the quantity of discharged ink drops can be increased. Thus, the print quality can be improved.

Moreover, the preliminary drive voltage signal 4 is supplied to the actuator 18 to vibrate the ink in the nozzle 14 during the unit drive period during which any ink drops are not discharged. The increase of the viscosity coefficient of ink can be prevented even if the period during which any ink drops are not discharged becomes long. Thus, the print quality can be improved.

Also, it not necessary to change the control based on whether or not any ink drop is discharged during the previous unit drive period. Thus, the control is never complicated.

Also, in this embodiment, as shown in FIG. 8B, when the print head 12 is moved from the outside of the print region to the inside of the print region, the preliminary drive voltage signal 6 is supplied to the actuator 18 in response to the print region signal immediately before the print head 12 enters inside of the print region. It should be noted that the time TL corresponds to the end of the print region in FIG. 8B.

In this case, the preliminary drive voltage signal 6 is identical with the preliminary drive voltage signal 4 except that the preliminary drive voltage signal 6 is supplied in the outside of the print region. Therefore, the vibration state of the ink meniscus at the timing TL is the same as the vibration state at the start timing of the second unit drive period. Therefore, even in the first unit drive period in the print region, it is possible for the ink drops to be discharged in the same condition as the other unit drive periods. Thus, the good print quality can be attained at the starting position in the print region.

What is claimed is:

1. An ink-jet printer comprising:

a nozzle from which ink drops are discharged in a print operation;

an ink storage room storing ink;

an actuator applying pressure to said ink stored in said ink storage room in response to each of a drive signal to cause discharge of ink drops from said nozzle and a preliminary drive signal; and a drive section selectively issuing one of said drive signal and said preliminary drive signal to said actuator for each of unit time periods, said preliminary drive signal having a lower voltage than said drive signal, each of said unit time periods being shorter than a time period needed until vibration of an ink meniscus in an end portion of said nozzle is attenuated.

2. The ink-jet printer according to claim 1, wherein said drive section issues said drive signal to said actuator at a start timing of a print unit time period of said unit time periods when said ink drops should be discharged in said print unit time period.

3. The ink-jet printer according to claim 1, wherein said drive section issues said preliminary drive signal to said actuator at a predetermined timing of a non-print unit time period of said unit time periods when said ink drops should not be discharged in said non-print unit time period.

4. The ink-jet printer according to claim 3, wherein a time from a start timing to said predetermined timing in one of said unit time periods is longer than a time from a start timing to a timing when said drive signal is issued in another of said unit time periods.

5. The ink-jet printer according to claim 3, wherein said predetermined timing in a unit time period is determined based on a vibration waveform of said ink meniscus when said drive signal was issued in an immediately previous unit time period.

6. The ink-jet printer according to claim 1, wherein said drive section determines a waveform of said preliminary drive signal and a timing of issuance of said preliminary drive signal and a timing of issuance of said preliminary drive signal such that a vibration of said ink meniscus at a start timing of a next unit time period subsequent to a current unit time period when said drive signal is issued is substantially the same as that of said ink meniscus when said preliminary drive signal is issued in said current unit time period.

7. The ink-jet printer according to claim 6, wherein said drive section includes:

a first drive circuit determining said waveform of said preliminary drive signal; and a second drive circuit determining said waveform of said drive signal.

8. The ink-jet printer according to claim 1, further comprising a print head, wherein said print head includes said nozzle, said ink storage room and said actuator, and wherein said drive section issues said preliminary drive signal in one of said unit time periods immediately before said print head is moved into a print region.

9. A method of driving a print head of an ink-jet printer, the method comprising:

issuing one of a drive signal and a preliminary drive signal in a first time period based upon an evaluation of a remaining vibration of an ink meniscus after said ink drop is discharged, wherein said preliminary drive signal has a lower voltage than said drive signal, said drive signal is capable of discharging an ink drop for a print operation, and said preliminary drive signal is not capable of discharging an ink drop.

10. The method according to claim 9, wherein said drive signal is issued at the start of said first time period.

11. The method according to claim 9, further comprising:

issuing said preliminary drive signal at a predetermined timing of a second time period.

12. The method according to claim 11, further comprising issuing said drive signal in said second time period, wherein a time from the start of said second time period to said predetermined timing of said second time period is longer than a time from the start of said second time period to when said drive signal is issued.

13. The method according to claim 11, wherein said predetermined timing is determined based on said remaining vibration of said ink meniscus when said drive signal is issued in said first time period.

14. The method according to claim 9, wherein a waveform of said preliminary drive signal and a timing of the issuance of said preliminary drive signal are determined such that said remaining vibration of said ink meniscus at a start of a second time period is substantially the same as that of said ink meniscus at a start of said first time period.

15. The method according to claim 14, further comprising:

issuing said preliminary drive signal in a time period immediately before the print head is moved into a print region.

16. An ink-jet printer comprising:

a nozzle from which ink drops are discharged in a print operation;

an ink storage room storing ink;

an actuator applying pressure to said ink stored in said ink storage room in response to each of a drive signal and a preliminary drive signal, said actuator causing vibration of an ink meniscus in said nozzle; and a drive section selectively issuing one of said drive signal and said preliminary drive signal to said actuator for each of unit time periods based on whether or not said ink drops should be discharged, said preliminary drive signal having a lower voltage than said drive signal, said drive signal causing a discharge of ink drops from said nozzle, and each of said unit time periods being shorter than a predetermined time period needed until vibration of said ink meniscus in an end portion of said nozzle is attenuated.

* * * * *